United States Patent [19]

Norton et al.

[11] Patent Number: 4,492,184

[45] Date of Patent: Jan. 8, 1985

[54] SOLIDS COOLING

[75] Inventors: James P. Norton, Elmwood Park; Lawrence P. Golan, Randolph, both of N.J.

[73] Assignee: Exxon Research and Engineering Co., Florham Park, N.J.

[21] Appl. No.: 541,530

[22] Filed: Oct. 13, 1983

[51] Int. Cl.[3] ..... F22B 1/02; F23G 7/00

[52] U.S. Cl. ..... 122/4 D; 122/367 PF; 165/104.18

[58] Field of Search ..... 122/4 D, 367 PF; 165/104.15, 104.18

[56] References Cited

U.S. PATENT DOCUMENTS

| | | | |
|---|---|---|---|
| 2,501,487 | 3/1950 | Whitman | 34/57 |
| 3,299,947 | 1/1967 | Boucraut et al. | 432/58 |
| 3,484,948 | 12/1969 | Whelan | 34/57 |
| 3,631,608 | 1/1972 | Maresca et al. | 34/10 |
| 3,921,590 | 11/1975 | Mitchell et al. | 165/104.18 |
| 4,111,158 | 9/1978 | Reh et al. | 122/4 D |
| 4,227,488 | 10/1980 | Stewart et al. | 122/4 D |
| 4,263,877 | 4/1981 | Urquhart | 122/4 D |

*Primary Examiner*—Edward G. Favors

*Attorney, Agent, or Firm*—Llewellyn A. Proctor

[57] ABSTRACT

Apparatus for cooling hot particulate solids, especially shale solids, and reclaiming heat therefrom. The apparatus is constituted of an elongate housing divided into two compartments by a distributor plate sloped from 0° to 15° from horizontal, with jet openings therethrough declined downwardly from vertical at an angle between about 0° to 45°. The upper compartment contains a tube type heat exchanger and can be provided with a bed of solids. The lower compartment constitutes a plenum having a gas manifold with gas inlets for injection of gas into the manifold for release through the jets of the distributor plate. The gas is injected at velocities insufficient to fluidize a significant portion of the solids to maximize heat transfer between the solids and heat exchanger, and it contacts and expands the bed of solids, and assists in the downward movement of the solids along the distributor plate. Hot particulate solids are delivered to the bed of particulate solids in the upper compartment, contacted with the tubes of the heat exchanger through which a fluid coolant is passed, and cool solids are discharged via a cool solids outlet.

9 Claims, 4 Drawing Figures

SOLIDS COOLING

FIELD THE INVENTION

This invention relates to a solids cooler. In particular, it relates to apparatus and process useful for the cooling, and recovery of heat from hot solids such as petroleum coke, ash, retorted shale and fluidized bed combustion draw off.

BACKGROUND OF THE INVENTION

It is often necessary to cool hot solids from various industrial sources, and generally it is also desirable to recover the heat from the solids. The decline of world petroleum crude reserves has led to the consideration of various alternate hydrocarbon sources, e.g., shale oil. Shale oil, one of the world's most important synthetic hydrocarbon sources, is now being developed as an alternate source of refining feedstocks. The shale rock is crushed and retorted at high temperatures to recover the oil from the rock. In an industrial process, after removal of oil from the shale rock, great amounts of hot, sometimes sticky shale particles must be cooled, and the heat recovered therefrom to provide an economic operation.

There are a number of problems associated with cooling large masses of particulate solids. Though the preponderance of the particulate matter are quite small, the particles are nonetheless generally of fairly wide range of size distribution, and at elevated temperatures the solids particles are sometimes sticky, which can restrict movement of the particles, and produce agglomerates. Conventional solids cooling is generally carried out in one of two major ways: first, by the use of fluidized beds; and, secondly, by the use of rotary coolers. In the use of fluidized beds to cool the solids, and recover the process heat, a large amount of the heat is given up to the fluidizing medium. The remainder (40–60%) can be absorbed by heat exchange within the bed. More heat is transferred to the stack via the fluidizing medium, and less heat to the process coil. Entrainment of solids is high, this resulting in the need for large clean up devices; and potentially, the need for additional heat exchange equipment. The ability of conventional fluidized systems to handle wide particle size distributions leaves much to be desired.

Rotary coolers too are of limited value for use in the recovery of heat from solids. They are large in size and contain many moving parts. One particular problem is with the rotary cooler joints in that they cannot adequately handle the two phase, high pressure, fluids. In particular, their limitation results in their not being able to generate high pressure steam which is often desirable in plant operation.

It is, accordingly, the primary object of this invention to obviate these and other of the disadvantages of conventional fluidized bed coolers and rotary coolers.

A particular object is to provide an apparatus, or unit containing a solids medium-coil cooling system wherein solids are cooled and much more heat is transferred to the process coil than to the fluidizing medium.

A further and more particular object is to provide a solids medium-coil cooling system as characterized wherein solids of fairly wide particle size distributions are cooled.

These objects and others are achieved in accordance with the present invention, characterized generally as a solids cooler comprised of a housing having enclosing walls, inclusive of side walls, end walls, and a perforated plate, or distributor which separates the housing into two compartments, a first upper compartment, and a lower compartment, or plenum, further subdivided into several chambers, an elongate tube type heat exchanger located within the upper compartment through the inside of which a coolant can be passed, a hot particulate solids inlet for the delivery of hot particulate solids into the upper compartment to form above the preforated plate, or distributor, a bed of particulate solids which can be expanded to cover said tube type heat exchanger by the injection of an inert or non-reactive gas into the plenum chamber, the gas entering the bed through the perforations within the plate, or distributor, and a cool particulate solids outlet through which the cooled particulate solids are discharged after heat exchange through the walls of the heat exchanger tube bundle with the coolant fluid.

The hot particulate solids are introduced into the upper compartment through the solids inlet, preferably at the surface level of the expanded bed. The perforated plate, or distributor, is sloped downwardly between the solids inlet and solids outlet at an angle ranging from 1° to about 10°, preferably from about 2° to about 8°, measured from horizontal, for gravity to aid the flow of solids, particularly the large solids particles which slip and slide along the upper surface of the distributor plate, moving from solids inlet to solids outlet. The perforations within the distributor, are jets sloped directionally such that the inert gas introduced from the plenum chamber through the perforated distributor plate is directed toward the cooled solids outlet, an angle ranging from about 0° to about 45° preferably from about 0° to about 25°, measured from vertical. The larger solids, as suggested, slip and slide along the upper surface of the perforated plate, or distributor, from the direction of the solids inlet to the solids outlet, aided by the inclination of the perforated plate, or distributor, and angularly directed jet openings, and the smaller particles are stratified as a layer, or as layers, above the larger particles and move directionally in generally similar fashion.

These features and others will be better understood by reference to the following more detailed description of the invention, and to the drawing to which reference is made. Similar numbers are used in the drawing to designate similar parts, or components, in the several different views, and where there are a plurality of similar parts, subscripts are used with the numbers. Where a whole number is used to designate an apparatus part, or component, and then subscripts are introduced with the whole number to designate the component parts, the whole number is intended in the generic sense. Where subscripts are introduced to designate an apparatus part, or component, and then dropped, the number from which the subscript, or subscripts, are dropped are intended to apply in the generic sense.

IN THE DRAWING

Figure 1:
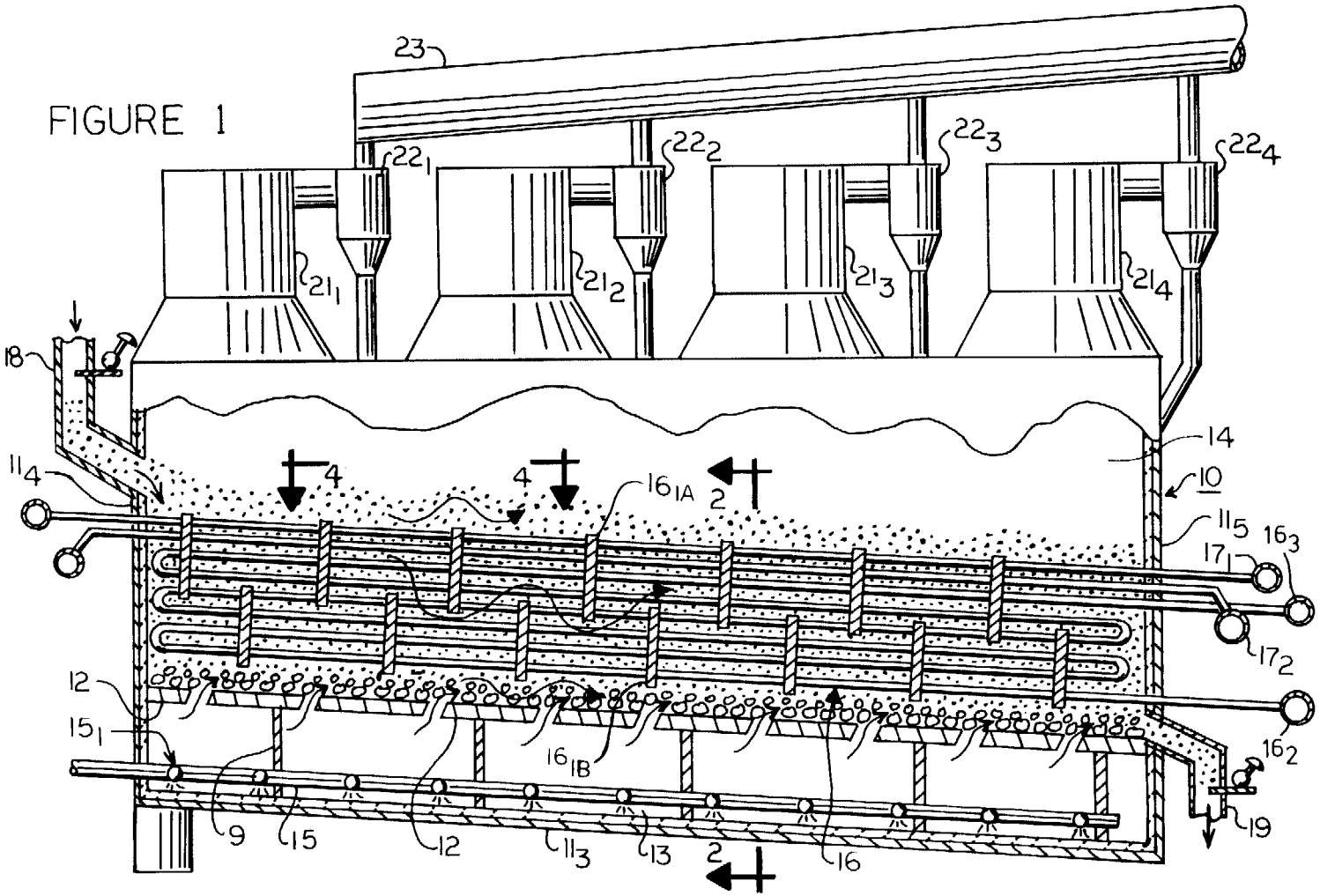
FIG. 1 depicts a side elevation view, in partial section, of a preferred solids cooler constituted generally of a housing, having enclosing walls divided by a sloped distributor plate into two compartments, an upper compartment in which can be contained a bed of solids, and a lower compartment, or plenum, into which gas can be injected and fed via the distributor plate into the bed of solids.

Referring generally to the figures, first to FIG. 1, there is shown a solids cooler 10 constituted of a large vessel or housing within the enclosing walls 11 of which is contained, near the bottom of the vessel, a sloped grid, perforated partitioning plate, or distributor plate 12 which divides the vessel into two compartments, a plenum 13 located between the floor $\mathbf{11}_3$ of the vessel and the distributor plate 12, and an upper chamber 14 located above the distributor plate 12 on which is supported a bed of particulate solids. A gas manifold system 15 is located within the plenum 13, gas, preferably air or steam, especially steam being injected via the fluidizing steam inlets $\mathbf{15}_1$, into the plenum 13 passing upwardly through the grid openings, perforations, or jets $\mathbf{12}_1$ of distributor plate 12, through the bed and into the upper chamber 14. A tube bundle 16 located within the upper chamber 14, held together via a series of tube sheets $\mathbf{16}_{1A}$, $\mathbf{16}_{1B}$ extends from one end wall $\mathbf{11}_4$ to the other $\mathbf{11}_5$. Hot water or low temperature steam is introduced into the process inlet side $\mathbf{16}_2$ of the tube bundle 16, and removed as high temperature steam from the outlet side $\mathbf{16}_3$ of the tube bundle 16. The upper chamber 14 can also be provided with an additional process coil, e.g., economizer coil 17, or coils $\mathbf{17}_1$, $\mathbf{17}_2$, located above (or below) the tube bundle 16. The upper chamber 14 is provided with a solids inlet 18 which enters the vessel just above the tube bundle 16, and a solids outlet 19 which is located at the opposite end of the solids cooler 10, and at the lower side of the bed. The distributor plate 12, which is supported in part by the partitioning walls 9, provides a particulate solids support surface, this surface with the wall $\mathbf{11}_1$, $\mathbf{11}_2$, $\mathbf{11}_4$, $\mathbf{11}_5$ forming within the upper chamber 14 in effect an elongate, rectangular shaped trough within which hot solids can be introduced via solids inlet 18, formed into a bed, the bed conveyed along the length of the trough while in heat-exchange relationship with the tube bundle 16, and the cooled solids withdrawn from the trough via the solids outlet 19.

Hot solids from an accumulator (not shown) are introduced into the vessel 10 via the solids inlet 18, the solids entering into, and filling, the trough-like portion of the upper chamber 14, the tube bundle 16 being immersed within the bed of particulate solids. Fluidizing-/conveying gas introduced via steam manifold 15 into the plenum 13 passes through the perforations or jets within the distributor plate 12. The solids particles are stratified, the larger particles setting upon the upper surface of distributor plate 12 where they slip and slide along the surface of the distributor plate 12 below the lowermost tube sheets $\mathbf{16}_{1B}$ making their way to the solids outlet 19. The movement of the large solids particles along the distributor plate surface is assisted by the declination from horizontal of the said distributor plate 12, and by the perforations or jets 12*l* of the distributor plate 12 which are preferably sloped toward the solids outlet 19. The smaller solids particles are stratified as a layer, or layers, above the upper surface of the distributor plate 12 some, passing over and some under, the tube sheets 16*1A*, $\mathbf{16}_{1B}$ as they progress from the hot solids inlet side of the cooler to the solids outlet 19. The solids move between the tube sheets $\mathbf{16}_{1A}$, $\mathbf{16}_{1B}$ and as they contact the tubes of the tube bundle 16 in their movement along the length of the trough, to impart their heat thereto and are cooled. Simultaneously, the heat from the solids particles heats the process fluid passing through the tube bundle 16 to a higher temperature. A fluid taken from the manifold outlet $\mathbf{16}_3$ can be used in processing the solids particulates by injection into the fluidizing/conveying gas manifold 15 via steam inlet $\mathbf{15}_1$ if that fluid is an acceptable fluidizing/conveying medium.

Fluidizing/conveying gas (air or stream) is injected into the upper chamber 14 from the steam manifold 15 via the jets of distributor plate 12 at relatively low velocities, suitably at velocities below the minimum fluidizing velocity of the particles to be cooled. It is important that the fluidizing/conveying velocity is sufficient to move the larger particles and to elutriate most of the small particles. Particles which are entrained in the gas are carried upwardly into a plurality of gas take-off stacks $\mathbf{21}_1$, $\mathbf{21}_2$, $\mathbf{21}_3$, $\mathbf{21}_4$, which lessens the flow velocity of the gas. The particles are removed from the gases via cyclone separations e.g., singly staged cyclone separators $\mathbf{22}_1$, $\mathbf{22}_2$, $\mathbf{22}_3$, $\mathbf{22}_4$, and the solids are reintroduced into the bed. The gas, after separation of the particles therefrom, is removed via the gas manifold outlet 23 and sent to a scrubber (not shown), if necessary.

Figure 2:
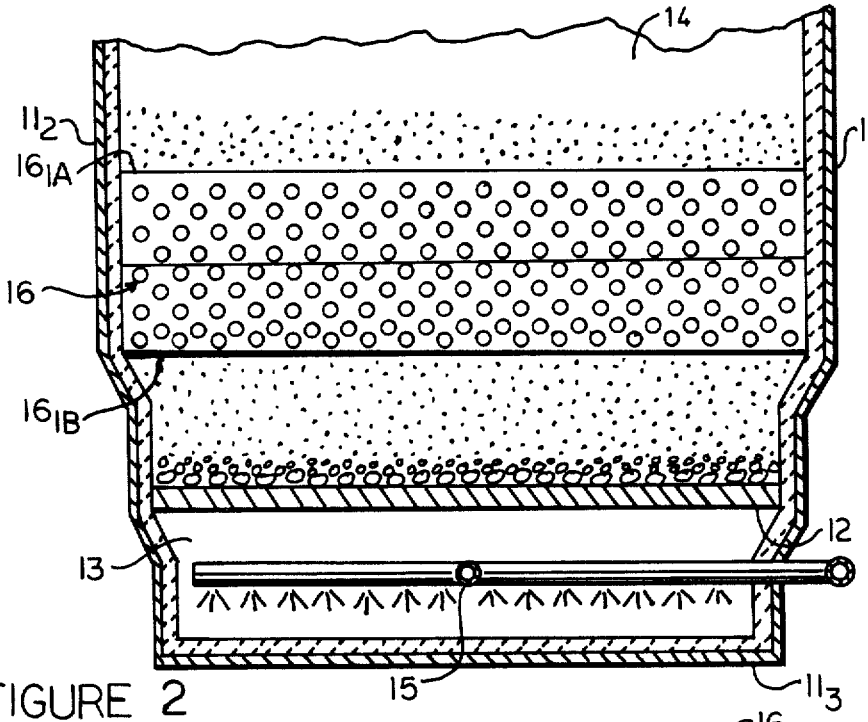
FIG. 2 depicts, in partial section, an end view of the preceeding figure taken along section 2—2 of FIG. 1.
Figure 4:
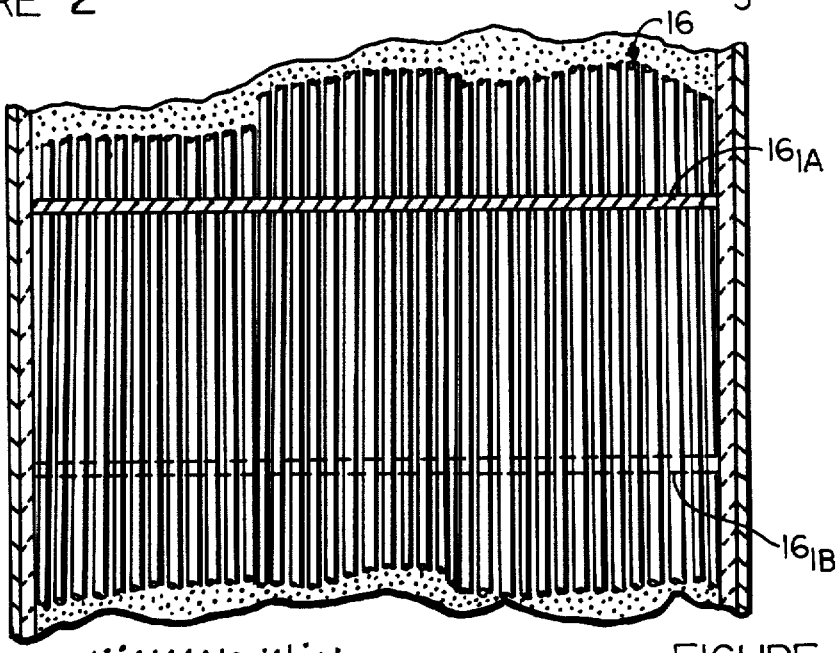
FIG. 4 depicts, in plan, a section view of the solids bed and solids cooler internals taken along line 4—4 of FIG. 1.

The stratification of the solids within the bed results in the largest particles being closest to the distributor plate 12. Reference is made, for convenience, to FIG. 2. The cross section of the upper chamber 14 of the vessel 10, as can be observed from this figure, is narrowest below the tube bundle 16, or cross-sectional area within which the tube bundle 16 is located. The refractory lined side walls $\mathbf{11}_1$, $\mathbf{11}_2$ of the vessel 10 are essentially parallel, and vertically oriented within the area of the tube bundle 16, but below the tube bundle 16 the walls $\mathbf{11}_1$, $\mathbf{11}_2$, are tapered inwardly such that the gas velocity is maximized at the upper surface of the distributor plate $\mathbf{12}_1$. The smaller particles, because they are suspended in the bed, move along relatively easily. The large particles, because of the reduced cross-sectional area of the bed at the surface level of the distributor plate 12, the orientation of the jet openings thereof, and slope of the distributor plate 12 are continuously conveyed to the solids outlet 19 without significant pile-up, bridging or pluggage of the jet openings. The cross-section of the freeboard area, or area above the tube bundle area is of the widest cross-section, disengagement of particles from the ascending gas taking place primarily within this area.

Figure 3:
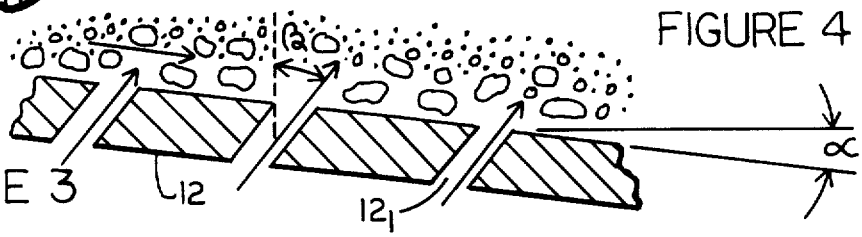
FIG. 3 depicts, in partial section, the area of the solids cooler divided by the sloped distributor plate into said upper compartment, and lower compartment, or plenum; the distributor plate supporting the bed of solids contained in said upper compartment.

The portion of the solids cooler 10 above the distributor plate 12 within which the bulk of the bed of solids is contained in essentially a long rectangular trough with straight sides except at the lowest portion where they are inwardly sloped. The flow of solids between the solids inlet 18 and solids outlet 19, because of the stratification of the solids particles, is essentially a counter-current pattern to optimize heat transfer. The counter currency is dependent upon the continuous movement of the hot solids from solids inlet 18 to solids outlet 19, resulting in a constantly decreasing temperature profile. Mixing of the solids is limited primarily to solids mixing in two directions, an up and down direction, and across the width of the bed. Mixing along the length of the bed is restricted by the slope of the distribution plate 12, the slope of which ranges between about 1° and about 10°, preferably from about 2° to about 8°, which suppresses back mixing of the solids, and aids the movement of the large particles along the surface of the distributor plate 12. Additionally, the jets $12_1$ of the distributor plate 12 are inclined sufficiently that the gas or steam entering the bed from the plenum 13 penetrates the bed in a downstream direction. Suitably, the jets $12_1$ of the distributor plate 12 as represented by the angle $\beta$ of FIG. 3 are inclined downwardly from the vertical in the direction of solids outlet 19 at an angle between about 0° and about 45° preferably from about 0° to about 25°. The tube bundle 16 is supported by tube sheets $16_{1A}$, $16_{1B}$ which obstruct backflow of the solids. Also, the lower rows of tube sheets $16_{1B}$, or tube sheets $16_{1B}$ supporting the lower rows of the tube bundle 16, are located to provide a free flow area or space between the distribution plate 12 and bottom of the tube sheet $16_{1B}$, to allow for the movement, or flow of large solids particles along the surface of the distributor plate 12. The upper tube sheets $16_{1A}$ are staggered or alternately positioned above the lower tube sheets $16_{1B}$ to provide a flow area between the lower plates $16_{1A}$ and upper plates $16_{1B}$ of the series.

The solids cooler 10 differs profoundly from the conventional fluidized bed wherein the solids are well mixed and the bed is of substantially uniform temperature. The bed of the solids cooler 10 is characterized as a jiggle bed, or sliding bed, and there is little horizontal mixing of the solids particles of the bed. The gas velocities are sufficient to make the solids slide along the trough portion of the solids cooler 10, but insufficient to fluidize a significant portion of the solids. This type of bed maximizes heat transfer between the hot solids and the immersed tubes of the tube bundle 16. Also because little fluidization gas is used most of the heat from the solids is absorbed by the immersed tubes of the tube bundle 16. In, e.g., a conventional fluidized bed the heat transfer may be split fifty-fifty between the fluidization gas and the steam tubes whereas, in contrast, in the jiggle or slide bed, the energy split is about ninety-five percent to the immersed tubes and about five percent to the gas.

It is apparent that various modifications and changes can be made in the apparatus, or process, without departing the spirit and scope of the invention.

Having described the invention, what is claimed is:

1. In apparatus for cooling hot particulate solids of a wide range of particle size distributions, and recovering heat therefrom principally by contact of the hot particulate solids with a tube type heat exchanger through which a coolant is passed, which comprises:

an elongate housing having enclosing end and side walls, the lower ends of the side walls of which slope inwardly, inclusive of a floor and a sloped distributor plate declined from horizontal at an angle, with jet openings therethrough directed downwardly in the direction of the slope and declined from the vertical at an angle between about 0° to 45°, located above the floor which partitions the housing into two compartments, an upper compartment the lower side of which is of reduced cross-section as compared with its upper side as produced by said inwardly sloped side walls, within which can be provided a bed of solids, and a lower plenum, inclusive of:

a gas manifold located within the plenum, inclusive of gas inlet means for injection of gas into the manifold for release through the jet openings of the distributor plate for contact and expansion of the bed of solids, at velocities insufficient to fluidize a significant portion of the solids to maximize heat transfer between the tube type heat exchanger and the solids, and assist in the movement of the solids along the surface of the distributor plate, a hot particulate solids inlet for the delivery of hot particulate solids to the bed of particulate solids within said upper compartment, an elongate tube type heat exchanger inclusive of a bundle of tubes held together via a series of tube sheets which extend from one side wall to the other side wall, and are alternately, vertically staggered one with regard to another to reduce the amount of backmixing of the solids, a plurality of said tubes oriented generally parallel to the major solids velocity component of solids movement, located within the upper compartment and immersed within the bed of particulate solids, through which the fluid coolant can be passed in heat exchange relationship with the solids, and a cool solids outlet located at the level of the distributor plate through which cooled solids can be discharged after passage of hot particulate solids from the hot solids inlet into the bed which moves downwardly along the sloped surface of the distributor plate, through the length of the upper compartment contacting the tubes of the heat exchanger to effect heat exchange between the hot particulate solids and the fluid coolant passed through the tubes of the heat exchanger sufficient to recover a principle amount of the heat from the solids, cooled solids being discharged through the cool solids outlet.

2. The apparatus of claim wherein the angle of slope of the distributor plate ranges between about 0° and 10°.

3. The apparatus of claim 1 where the jets are declined downwardly from the vertical at an angle between about 0° to 25°.

4. The apparatus of claim 1 wherein the angle of slope of the distributor plate ranges between about 0° and 10°, and the jets of the distributor plate are declined downwardly at an angle between about 0° to 25°.

5. The apparatus of claim 1 wherein the elongate housing has enclosing walls inclusive of side walls and end walls upon which are supported a plurality of gas take off stacks to each of which is associated one or more cyclone separators for the separation of fines solids particles from the gas for return to the bed, and a gas manifold for take off of gas.

6. An apparatus for cooling hot particulate shale solids, and recovering heat therefrom, which comprises:

an elongate housing having enclosing end and side walls, the lower ends of the side walls of which slope inwardly, inclusive of a floor and a distributor plate declined from horizontal at an angle ranging between about 0° and 15°, with jet openings therethrough declined from the vertical at an angle ranging between about 0° or 45°, located above the floor which partitions the housing into two compartments, an upper compartment the lower side of which is of reduced cross-section as compared with its upper side as produced by said inwardly sloped side walls, within which can be provided a bed of solids, and therebelow a plenum inclusive of:

a steam manifold located within the plenum, inclusive of steam inlet means for injection of steam into the manifold for release through the jet openings of the distributor plate for contact and expansion of the bed of shale solids, a hot particulate solids inlet for the delivery of hot particulate solids to the bed of particulate solids within said upper compartment, an elongate tube type heat exchanger inclusive of a bundle of tubes held together via a series of tube sheets which extend from one side wall to the other side wall, and are alternately vertically staggered one with regard to another to reduce the amount of backmixing of the solids, said bundle of tubes including a plurality of tubes oriented parallel to the major solids velocity component of solids movement, located within the upper compartment and immersed within the bed of particulate shale solids, through which a fluid coolant can be passed, and a cool solids outlet located at the level of the distributor plate through which cooled shale solids can be discharged after passage of hot particulate shale solids from the hot solids inlet into the bed which moves downwardly along the declined surface of the distributor plate, through the length of the upper compartment contacting the tubes of the heat exchanger to effect heat exchange between the hot particulate shale solids and the fluid coolant passed through the tubes of the heat exchanger sufficient to recover a principle amount of the heat from the solids, cooled shale solids being discharged through the cool solids outlet.

7. The apparatus of claim 6 wherein the angle of declination of the distributor plate ranges between about 0° and 10°.

8. The apparatus of claim 6 where the jets are declined at an angle between about 0° to 25°.

9. The apparatus of claim 6 wherein the angle of declination of the distributor plate ranges between about 0° and 10°, and the jets of the distributor plate are declined at an angle between about 0° to 25°.

* * * * *